US010889943B2

(12) United States Patent
Goutermont

(10) Patent No.: US 10,889,943 B2
(45) Date of Patent: Jan. 12, 2021

(54) SYSTEM AND METHOD FOR OPERATING A PAVING MACHINE

(71) Applicant: Caterpillar Paving Products Inc., Minnesota, MN (US)

(72) Inventor: Steven Paul Goutermont, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/111,311

(22) Filed: Aug. 24, 2018

(65) Prior Publication Data

US 2020/0063384 A1 Feb. 27, 2020

(51) Int. Cl.
*E01C 19/48* (2006.01)
*E01C 23/00* (2006.01)

(52) U.S. Cl.
CPC ..... *E01C 19/48* (2013.01); *E01C 23/00* (2013.01); *E01C 2301/00* (2013.01)

(58) Field of Classification Search
USPC ..... 701/50
See application file for complete search history.

(56) References Cited

U.S. PATENT DOCUMENTS 4,933,853 A * 6/1990 Musil ..... E01C 19/006 37/382
5,356,238 A * 10/1994 Musil ..... E01C 19/008 404/101
5,787,374 A * 7/1998 Ferguson ..... B62D 11/183 180/6.32
5,938,371 A 8/1999 Gustin et al.
6,272,935 B1 * 8/2001 Strubbe ..... G01F 1/206 73/861.73
6,375,012 B1 * 4/2002 Leyland ..... E02F 3/407 209/393
6,449,539 B1 * 9/2002 Ohno ..... G05B 23/0229 340/439
RE38,632 E * 10/2004 Schmidt ..... B62D 11/003 180/6.32

(Continued)

FOREIGN PATENT DOCUMENTS

CN 102294990 A * 5/2011

OTHER PUBLICATIONS

Google Translation of Chinese Patent Application Pub. No. CN102294990A that published in 2011 (hereinafter the '990 application)(dated Oct. 18, 2019).*

(Continued)

*Primary Examiner* — Jean Paul Cass
(74) *Attorney, Agent, or Firm* — Oblon, McClelland, Maier & Neustadt

(57) ABSTRACT

A method for operating a paving machine is provided. The paving machine includes a screed assembly, a washdown system for washing the paving machine and the screed assembly and a ventilation system. The method includes receiving, by a controller, an operational data associated with the paving machine, and determining an operational state associated with the washdown system. The method further includes controlling, by the controller, an operation of the ventilation system based on the operational data associated with the paving machine and the operational state associated with the washdown system.

6 Claims, 4 Drawing Sheets

(56) References Cited

U.S. PATENT DOCUMENTS 8,930,092 B2 * 1/2015 Minich ..... E01C 19/48 701/50
9,045,870 B2 6/2015 Buschmann et al.
2001/0002753 A1 * 6/2001 Hollwarth-Oberholz ..... G09F 3/0289 283/81
2005/0175412 A1 * 8/2005 Lloyd ..... E01C 23/065 404/77
2005/0193937 A1 * 9/2005 Freelund ..... B63B 25/008 114/73
2006/0127190 A1 * 6/2006 Kremer ..... E02D 3/046 405/271
2008/0105099 A1 * 5/2008 Backman ..... B23Q 9/0078 83/468.4
2010/0269860 A1 * 10/2010 Vogel ..... E01H 1/103 134/10
2011/0088586 A1 * 4/2011 Huang ..... B64G 7/00 104/287
2012/0070674 A1 * 3/2012 Sebralla ..... C23C 22/76 428/447
2013/0089375 A1 * 4/2013 Noll ..... F04D 15/0066 404/84.05
2014/0224282 A1 * 8/2014 Schick ..... B05B 7/04 134/36
2014/0326821 A1 * 11/2014 Bishop ..... B26D 1/185 242/533.8
2015/0308124 A1 * 10/2015 Newman ..... E04F 13/0862 52/747.11
2015/0337504 A1 * 11/2015 Jorgensen ..... E01C 19/40 404/114
2015/0361627 A1 * 12/2015 Frelich ..... E01C 19/4853 180/65.245
2017/0260702 A1 * 9/2017 Graham ..... E01C 19/4806
2017/0333842 A1 * 11/2017 Robinson ..... F24F 3/16
2018/0356113 A1 * 12/2018 Kirpichnikov ..... F24F 11/30
2019/0174207 A1 * 6/2019 Cella ..... G08C 15/00
2019/0315491 A1 * 10/2019 Allen ..... B64F 5/30

OTHER PUBLICATIONS

Unknown, "CAT F Series Pavers and Screeds, Built for It" CAT Brochure, (2014)(http://s7d2.scene7.com/is/content/Caterpillar/C10364580).*

* cited by examiner

SYSTEM AND METHOD FOR OPERATING A PAVING MACHINE

TECHNICAL FIELD

The present disclosure generally relates to a paving machine and more particularly, to a control system and method for operating the paving machine.

BACKGROUND

Paving machines are commonly known to use asphalt material for the purposes of laying or forming hard surface roads. Generally, these paving machines include an operator station for permitting an on-board operator to ensure that the asphalt material is properly placed and that the resulting road surface is properly laid. The asphalt material is leveled and compacted by a screed assembly located at a rear of the paving machine. The asphalt material generally used for the construction of hard surfaces includes a mixture of an aggregate, such as sand, gravel, rock material and an asphalt binding material. The asphalt material, when heated during operation, tends to emit substantial amounts of hydrocarbons and other foul-smelling fumes. A ventilation system is provided on-board the paving machine, to ventilate these fumes out of the paving machine through ducts and other exhaust systems provided thereon. The ventilation system generally switches to an ON state automatically, as soon as an engine speed of the paving machine reaches a threshold value for a predefined time period and remains in the ON state until the engine speed reaches below the threshold value or if the paving machine is switched off.

Additionally, the paving machine may also include a wash down system for cleaning the screed assembly and its components during operation, by spraying a releasing agent, such as diesel, onto the surface of the screed assembly. The operator of the paving machine may manually activate washdown system to clean the screed assembly. However, whenever the washdown system is activated, the ventilation system is also running to draw the fumes generated by the paving machine. Therefore, as the washdown system sprays the releasing agent on the screed assembly, the releasing agent also gets drawn by the ventilation system. This may eventually cause damage to the ventilation system, the ducting and the exhaust system of the paving machine.

U.S. Pat. No. 9,045,870 (hereinafter referred to as the '870 patent) relates to a road finishing machine having a screed, a machine control, and a ventilation system including a fan. The fan can be switched on or off via the machine control automatically independent of the operator and exclusively depending on demand. The '870 patent further describes that before or during the laying operation, a defined demand for the operation of the ventilation system is determined and during or for the laying operation, the ventilation system is operated independent of the operator and automatically and optionally power controlled, upon determination of the defined demand.

SUMMARY OF THE INVENTION

In one aspect, a method for operating a paving machine is provided. The paving machine includes a screed assembly, a washdown system for washing the screed assembly and a ventilation system. The method includes receiving, by a controller, an operational data associated with the paving machine, and determining an operational state associated with the washdown system. The method further includes controlling, by the controller, an operation of the ventilation system based on the operational data associated with the paving machine and the operational state associated with the washdown system.

In another aspect, a control system for operating a paving machine is provided. The paving machine includes a screed assembly, a washdown system for washing the screed assembly and a ventilation system. The control system includes one or more machine sensors associated with the paving machine, and a controller communicably coupled to the one or more machine sensors, the washdown system and the ventilation system. The controller is configured to receive an operational data associated with the paving machine, and determine an operational state associated with the washdown system. The controller is further configured to control an operation of the ventilation system based on the operational data associated with the paving machine and the operational state associated with the washdown system.

In a yet another aspect, a paving machine is provided. The paving machine includes a screed assembly, a washdown system for cleaning the screed assembly, a ventilation system, one or more machine sensors for monitoring one or more operational data associated with the paving machine and a controller. The controller is communicably coupled to the washdown system, the ventilation system and the one or more machine sensors. The controller is configured to receive a machine speed associated with the paving machine, from the one or more machine sensors. The controller also determines an operating mode associated with the paving machine and an operational state associated with the washdown system. The controller is further configured to switch an operation of the ventilation system between an ON state and an OFF state based on the machine speed, the operating mode associated with the paving machine and the operational state associated with the washdown system.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

Figure 1:
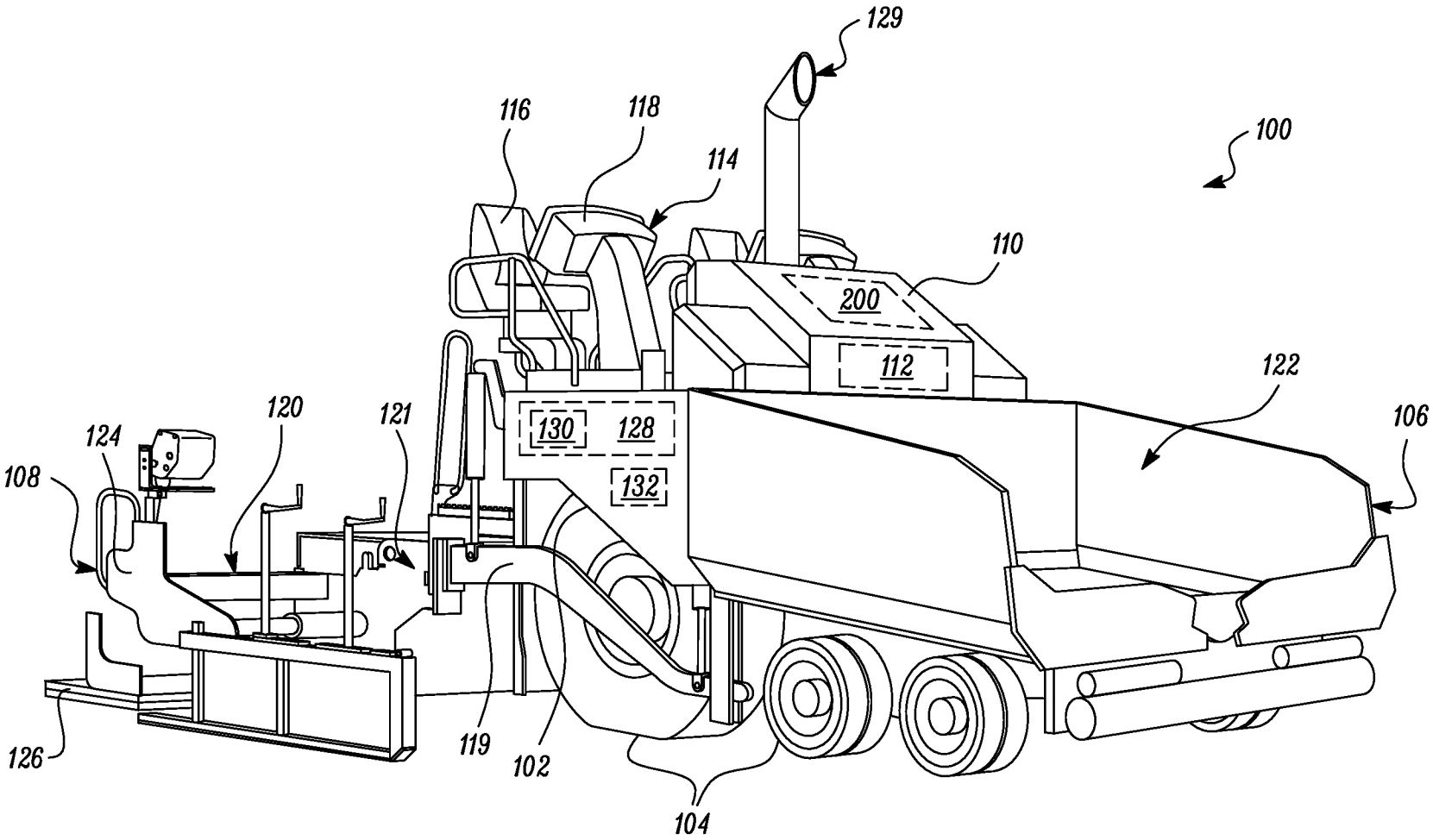
FIG. 1 illustrates an exemplary machine, in accordance with the concepts of the present disclosure.

The present disclosure relates to a control system and method for operating a paving machine. FIG. 1 illustrates an exemplary machine 100 shown as a paving machine, according to an embodiment of the present disclosure. The paving machine 100 may be an asphalt paver or may be any other machine used to distribute a layer of paving material on the surface of a roadway or other area.

The machine 100 includes a frame 102 with a set of ground engaging members 104, such as wheels or tracks, coupled with the frame 102. The frame 102 includes a front portion 106 and a rear portion 108. The machine 100 further includes a tractor portion 110 supported on the frame 102.

The tractor portion 110 includes a power source 112 and an operator station 114. The power source 112 may be an engine, such as an internal combustion engine, configured to power operations of various systems on the machine 100, such as the ground engaging members 104. The operator station 114 includes an operator seat 116 and a console 118, which may include various controls for directing operations of the machine 100. For example, the console 118 may include one or more touch screens, joysticks, switches etc., to facilitate the operator in operating the machine 100.

The machine 100 includes a screed assembly 120 configured to spread and compact paving material into a layer or mat of a desired thickness, size and uniformity on a paving surface. In an exemplary embodiment, the screed assembly 120 includes a free-floating screed coupled with the machine 100, via tow arms 119, at a drop arm 121 of the screed assembly 120. The machine 100 further includes a hopper 122 supported on the front portion 106 of the frame 102 and configured to receive and store the paving material and a conveyor system having one or more conveyors (not shown) configured to move the paving material from the hopper 122 to the screed assembly 120. In one example, the screed assembly 120 may be capable of extending to allow for wider paving applications and may include a screed extender 124 having an extender plate 126 to widen and narrow, as required, to lay the appropriate mat width for a particular paving job.

The machine 100 further includes a ventilation system 128 having at least one fan 130 that may be switched on for drawing in together with ambient air, fumes, vapors and aerosols which are released in operation from the paving material inside the machine 100 and optionally also behind the screed assembly 120. The ventilation system 128 is further configured to discharge the fumes, vapors and the aerosols via a discharge pipe 129 to a top of the machine 100, for example, through a filter device (not shown), away from an operator positioned in the operator station 114, from other workers working on and in proximity of the screed assembly 120 and also away from the direct surroundings of the machine 100. It may be contemplated that the ventilation system 128 may be connected to the one or more exhaust ducts (not shown) of the machine 100 to facilitate exit of the fumes, vapors and aerosols away from the operator and the other workers associated with the machine 100. The ventilation system 128 may be a standard ventilation system commonly known in the art and thus the detailed working of the ventilation system 128 is not included herein for the sake of brevity of the present disclosure.

Figure 2:
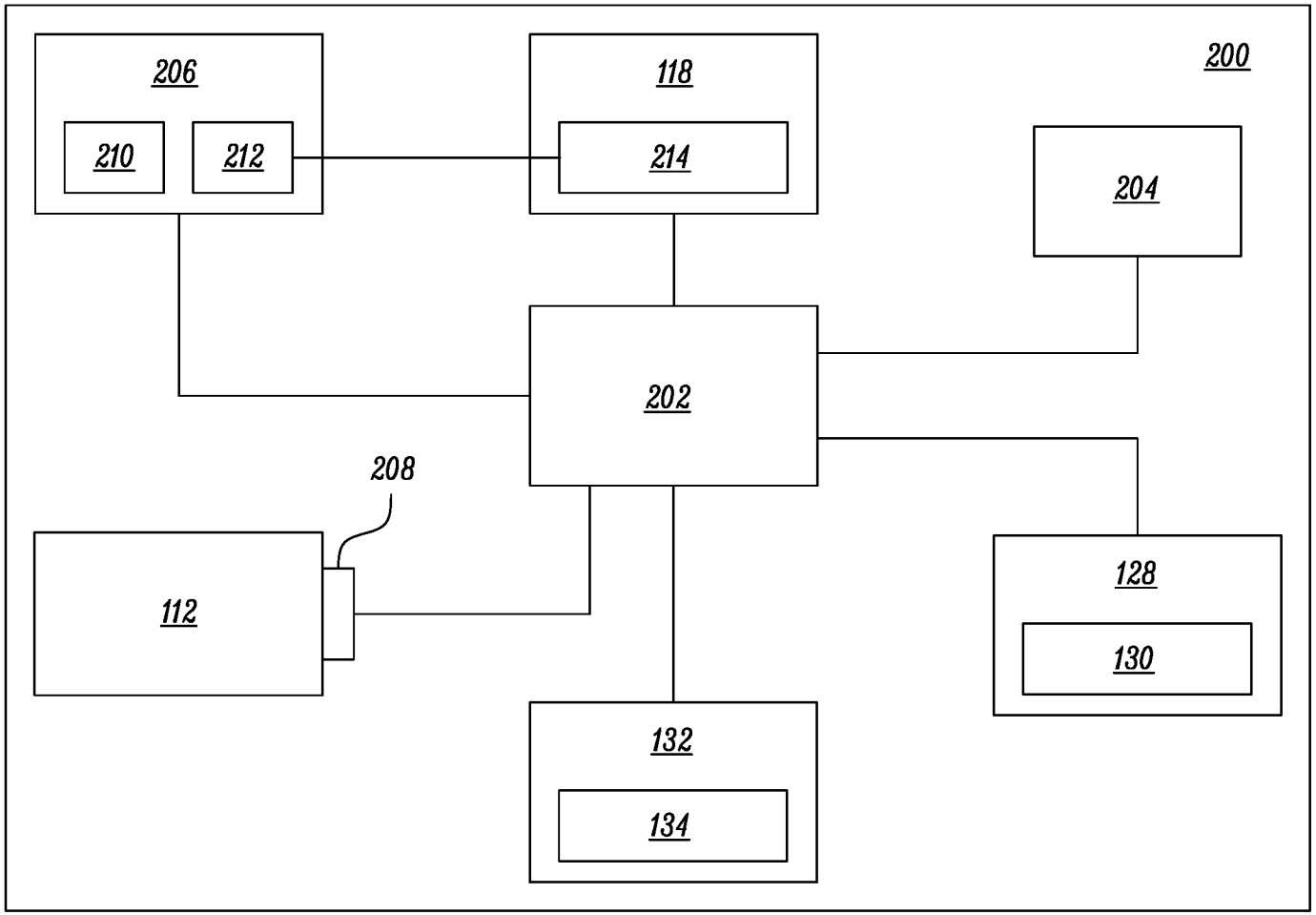
FIG. 2 illustrates an exemplary control system for operating the machine, in accordance with the concepts of the present disclosure.

The machine 100 may further include a washdown system 132 configured to facilitate cleaning of the paving machine 100, the screed and other components of the screed assembly 120 to prevent asphalt materials deposition on surfaces of the machine 100 and the components of the screed assembly 120. The washdown system 132 includes a tank 134 (as shown in FIG. 2) configured to hold a releasing agent, such as diesel, and a spray device (not shown) to spray the releasing agent onto the surface of the screed and other components of the screed assembly 120 and the machine 100. In some embodiments, the washdown system 132 may be positioned on-board the machine 100. In other embodiments, the washdown system 132 may be located off-board the machine 100 and may be brought to the machine 100 as and when required. The washdown system 132 may be manually controlled by the operator of the machine 100 through the console 118.

In an embodiment of the present disclosure, the machine 100 includes a control system 200 for operating the machine 100 and various components of the machine 100. The control system 200 includes suitable logic, circuitry, and/or interfaces that are configured to control the various operations of the machine 100. A person having ordinary skill in the art would appreciate that the scope of the disclosure is not limited to include the control system 200 provided onboard the machine 100. In some embodiments, the control system 200, or portions of the control system 200, may be implemented remotely with respect of the machine 100, without departing from the scope of the disclosure. Detailed working of the control system 200 is further described in conjunction to FIGS. 2 through 3A and 3B.

Referring to FIG. 2, the control system 200 includes a controller 202, a memory device 204, one or more machine sensors 206, and one or more engine sensors 208 associated with the power source 112. Additionally, or alternatively, the control system 200 may include fewer or additional elements.

The controller 202 is communicably coupled to the console 118, the memory device 204, the one or more machine sensors 206, and the one or more engine sensors 208 and controls operations of the machine 100 and the various components of the machine 100. The controller 202 is configured to execute the instructions stored in the memory device 204 to perform predetermined operations. The controller 202 may be implemented using one or more controller technologies, such as Application Specific Integrated Circuit (ASIC), Reduced Instruction Set Computing (RISC) technology, Complex Instruction Set Computing (CISC) technology, etc. In an exemplary embodiment, the controller 202 may be implemented on the electronic control module (ECM) associated with the machine 100.

The memory device 204 is configured to store a set of instructions that are executable by the controller 202 to perform the predetermined operation (for example, controlling the operations of the machine 100). The memory device 204 may include, but is not limited to, a Random-Access Memory (RAM), a Read Only Memory (ROM), a Hard Disk Drive (HDD), and a Secure Digital (SD) card.

In an embodiment of the present disclosure, the controller 202 is configured to control operations of the ventilation system 128 and the washdown system 132 based on inputs received from the console 118, the one or more machine sensors 206 and the one or more engine sensors 208. The detailed operations of the controller 202 for controlling the operations of the ventilation system 128 and the washdown system 132 will be described in the following description of the present application.

In an exemplary embodiment of the present disclosure, the one or more machine sensors 206 includes a machine speed sensor 210 to detect the machine speed (such as in Feet per minute or Kilometer or miles per hour) and an operating mode detector 212 to detect an operation mode associated with the machine 100. For example, the machine 100 may be configured to operate in one or more operating modes, namely, maneuver mode, paving mode, and/or travel mode. The maneuver mode allows the machine 100 to rotate within its own foot-print for turning capabilities. In the paving mode, the machine 100 may be configured to perform paving operations. Further, the travel mode allows maximizing speed of the machine 100 for travel. The operator of the machine 100 may activate a desired mode of operation via a user interface 214 provided on the console 118. Based on the operator input, the operating mode detector 212 may detect the operation mode of the machine 100 and the controller 202 may switch the operation mode of the machine 100 according to the operator input.

Further, the one or more engine sensors 208 are configured to monitor engine operational parameters, such as engine speed, engine temperature, etc., and configured to provide operational parameters associated with the power source 112 to the controller 202.

The controller 202 is configured to control the operations of the washdown system 132 based on an operator input received via the user interface 214. For example, the operator of the machine 100 may provide an input to switch the washdown system 132 to an ACTIVE operational state via the user interface 214, to start a washdown operation of the screed assembly 120 and/or the machine 100, whenever desired. The controller 202 is configured to receive the operator input from the user interface 214 and switch the washdown system 132 to the ACTIVE operational state in response to the operator input. Similarly, when the washdown system 132 is in ACTIVE operational state and the operator provides an input to switch the washdown system 132 to a DEACTIVATED operational state via the user interface 214, then the controller 202 switches the washdown system 132 to the DEACTIVATED operational state based on the operator input.

In an embodiment of the present disclosure, the controller 202 is configured to switch operations of the ventilation system 128 between an ON state and OFF state based on the operational data associated with the machine 100, the one or more operational parameters associated with the power source 112 and the operational state associated with the washdown system 132. For example, the controller 202 is operatively coupled to the fan 130 of the ventilation system 128 and configured to switch the fan 130 between an ON and OFF position, to switch the ventilation system 128 between the ON state and the OFF state.

In operation, initially the controller 202 is configured to receive the engine speed from the engine sensors 208 and detect the operational mode of the machine 100 based on the input received from the operating mode detector 212 associated with the machine 100. The controller 202 is configured to switch the ventilation system 128 to the ON state when the engine speed is greater than a first threshold value T1 for a predefined time period and the operating mode of the machine 100 is either maneuver mode or paving mode. In one example, the first threshold value T1 is 900 rotations per minute (RPM) and the predefined time period is 30 seconds. It may also be contemplated by a person skilled in the art that the ventilation system 128 may also be switched to the ON state irrespective of the operating mode of the machine 100, as long as the engine speed is determined to be greater than the first threshold value T1 for the predefined time period.

In an embodiment of the present disclosure, the controller 202 is further configured to determine the operational data associated with the machine 100 and the operational state associated with the washdown system 132 and accordingly control the operation of the ventilation system 128. For example, the operational data associated with the machine 100 includes a machine speed as received from the machine speed sensor 210 and the operating mode of the machine 100 as received from the operating mode detector 212 associated with the machine 100. Further, the controller 202 may determine the operational state of the washdown system 132 from the console 118 based on the operator input provided via the user interface 214. In other examples, the washdown system 132 may have sensors operatively coupled to the controller 202 and the controller 202 may be configured to determine the operational state of the washdown system 132 based on inputs received from these sensors.

In an embodiment of the present disclosure, the controller 202 is configured to control the operation of the ventilation system 128 based on the machine speed, the operating mode of the machine 100 and the operational state of the washdown system 132. For example, when the controller 202 receives that the machine 100 is operating in either the maneuver mode or the paving mode, that the machine speed is less than or equal to a second threshold value T2 and that the washdown system 132 is in the ACTIVE state, then the controller 202 switches off the fan 130, thereby switching the ventilation system 128 to the OFF state. In an exemplary embodiment, the second threshold value T2 may be with a range of Five Feet per minute (FPM) and Zero FPM. According to an embodiment of the present disclosure, the second threshold value T2 is Zero FPM, such that when the machine speed is received to be equal to or less than Zero FPM, i.e., when the machine 100 is not moving, and the machine 100 is determined to be operating in maneuver or paving mode with the washdown system 132 being in the ACTIVE state, then the controller 202 is configured to switch off the fan 130 of the ventilation system 128, thereby switching the ventilation system 128 to the OFF state.

Further, as soon as the controller 202 detects that the washdown system 132 is not operating or is in the DEACTIVATED state, or if the machine speed is higher than the second threshold value T2 and the machine 100 is still operating in the maneuver or paving mode, the controller 202 switches on the fan 130, thereby switching the ventilation system 128 to the ON state.

INDUSTRIAL APPLICABILITY

The control system 200 of the paving machine 100 facilitates switching the ventilation system 128 to OFF state when the washdown system 132 is operational and the speed of the machine 100 is less than the second threshold value T2 while the machine 100 is in maneuver or paving mode. This prevents the ventilation system 128 from taking in the releasing agent, sprayed by the washdown system 132, along with the fumes and aerosols, when the washdown system 132 is operational.

Figure 3A:
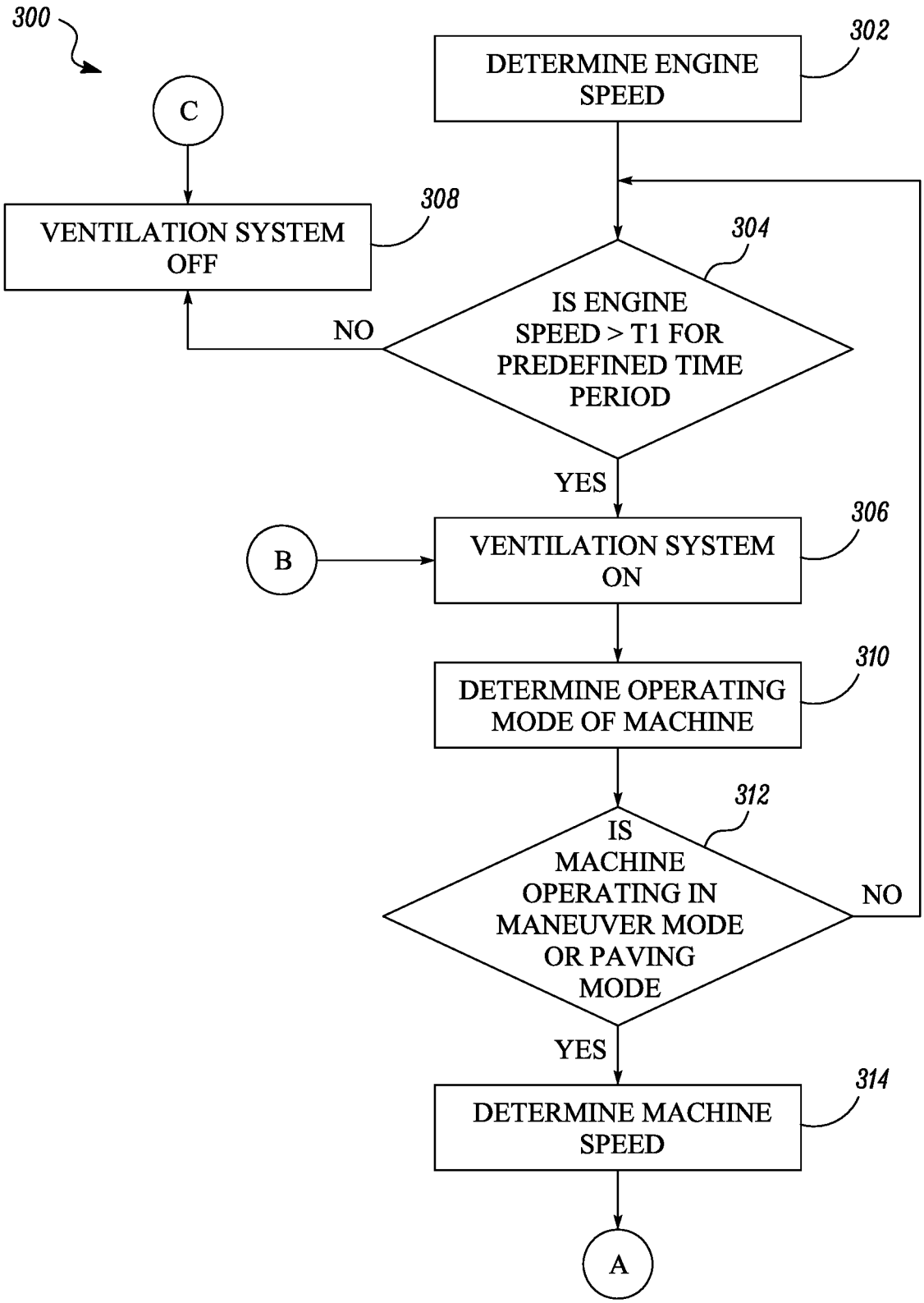
FIG. 3A and FIG. 3B illustrate an exemplary method for operating the machine, in accordance with the concepts of the present disclosure.
Figure 3B:
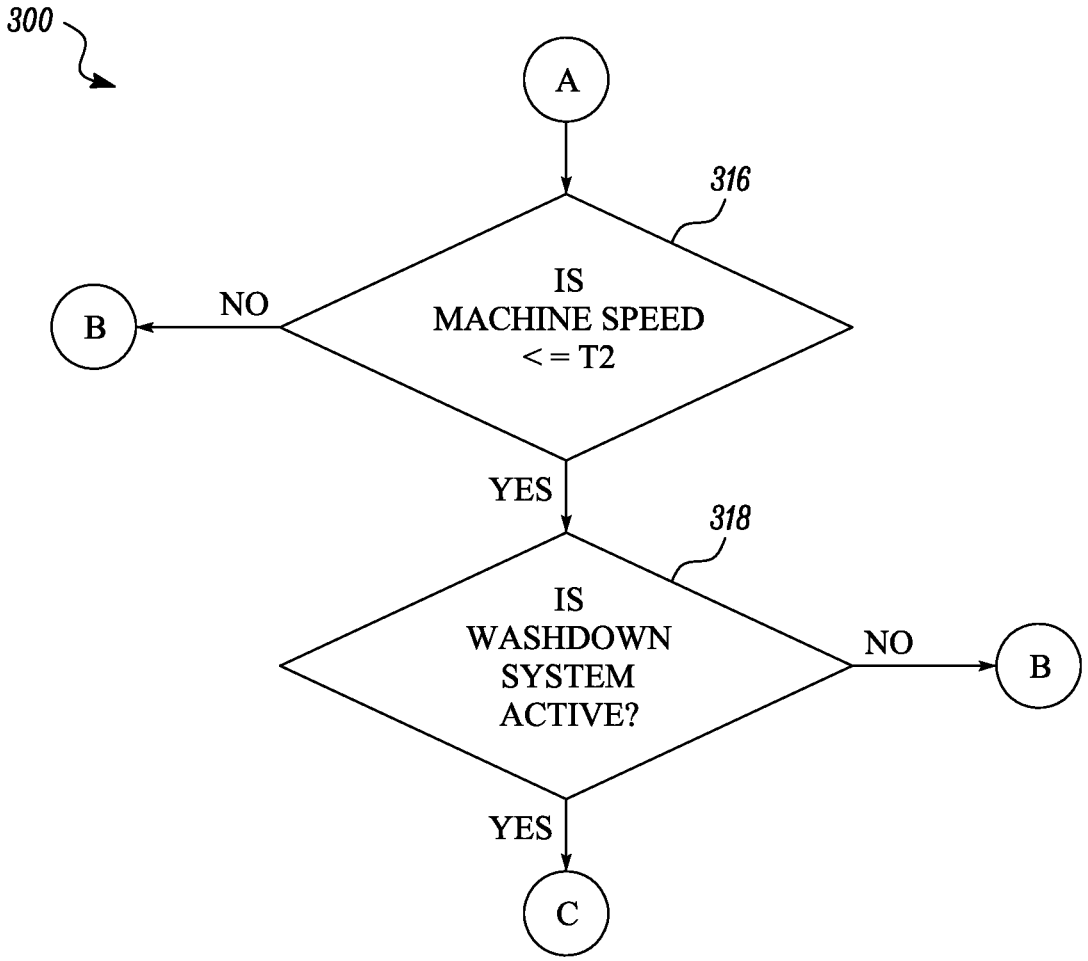

FIGS. 3A and 3B illustrates an exemplary method 300, performed by the controller 202 of the control system 200, for controlling operations of the paving machine 100, in accordance with the embodiments of the present disclosure.

Initially, at step 302, the controller 202 determines the engine speed based on the inputs received from the one or more engine sensors 208. Further, at step 304, the controller 202 checks if the engine speed is greater than the first threshold value T1 for a predefined period of time. In an exemplary embodiment, the controller checks if the engine speed is greater than 900 RPM for the predefined time period of 30 seconds.

The method moves to step 306 if the controller 202 determines that engine speed is greater than the first threshold value T1 for the predefined time period. At step 306, the controller 202 switches the ventilation system 128 to the ON state, by switching on the fan 130 of the ventilation system 128. However, if the controller 202 determines that the engine speed is less than the first threshold value T1 and/or not for the predefined time period, then the ventilation system 128 remains at the OFF state, at step 308.

Once the ventilation system 128 is switched to the ON state at step 306, the method moves to step 310 where the controller 202 determines the operating mode of the paving machine 100. In one example, the machine 100 may be operating in one of the maneuvering mode, paving mode, or travel mode. The controller 202 determines the operating mode based on the inputs received from the operating mode detector 212 and/or the operator input received via the user interface 214 of the console 118.

At step 312, the controller 202 checks if the machine 100 is operating in either maneuver mode or the paving mode. When the controller 202 detects that the machine 100 is not operating in one of the maneuver mode or the paving mode, (i.e., the NO branch), the controller 202 moves back to step 304 to determine the engine speed and accordingly proceeds further to switching the ventilation system 128 to the ON state or the OFF state. However, when the controller 202 determines that the machine 100 is operating in one of the maneuvering mode or the paving mode (i.e., the YES branch), then the controller 202 determines the machine speed at step 314. For example, the controller 202 determines the machine speed based on the input received from the machine speed sensor 210. Although the method 300 indicates that the ventilation system 128 is switched to the ON state before determining the operating mode of the machine 100, in some alternative embodiments, the switching of the ventilation system 128 to the ON state may be done only when the machine 100 is operating in either the maneuver mode or the paving mode.

The controller 202 moves to step 316 to check if the machine speed is less than or equal to the second threshold value T2. In an embodiment, the second threshold value T2 may be within a range of 5 Feet per minute (FPM) to Zero FPM. In an example, the second threshold value T2 is Zero FPM. Therefore, the controller 202, at step 316 checks if the machine speed is less than or equal to Zero FPM.

If at step 316, the controller 202 determines that the machine speed is greater than the second threshold value T2 (i.e., the NO branch), then the controller 202 moves to step 306 where the ventilation system 128 remains in the ON state. However, if at step 316 the controller 202 determines that the machine speed is less than or equal to the second threshold value T2 (i.e., the YES branch), the controller 202 proceeds to step 318.

At step 318, the controller 202 further detects whether the washdown system 132 is in the ACTIVE state. For example, the controller 202 may receive operator input via the user interface 214 to activate the washdown system 132. In an embodiment of the present disclosure, if at step 318, the controller 202 detects that the washdown system 132 is in ACTIVE state (i.e., the YES branch), then the controller 202 moves to step 308 and switches the ventilation system 128 to the OFF state. However, if the controller 202 detects that the washdown system 132 is not in ACTIVE state or is DEACTIVATED, then the controller 202 moves to step 306 where the ventilation system 128 remains in the ON state.

The method 300 is performed repeatedly by the controller 202 as long as the machine 100 is switched on or operational. Therefore, whenever the washdown system 132 is ACTIVE and the machine speed is less than or equal to the second threshold value T2 and operating in either the maneuver mode or paving mode, the controller 202 switches the ventilation system 128 to the OFF state. Subsequently, whenever the machine speed is determined to be greater than the second threshold value T2, the controller 202 switches the ventilation system 128 back to the ON state.

Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A method for operating a paving machine, the paving machine including a screed assembly, a washdown system for washing the paving machine and the screed assembly, and a ventilation system, the method comprising:

receiving, by a controller, operational data associated with the paving machine, the operational data including a machine speed of the paving machine, an operating mode of the paving machine, and a speed of an engine of the paving machine;

determining, by the controller, an operational state of the washdown system of the paving machine; and controlling, by the controller, an operation state of the ventilation system based on the operational data associated with the paving machine and the operational state of the wash down system of the paving machine, wherein said controlling the operational state of the ventilation system includes switching the operation state of the ventilation system, based on whether the speed of the engine is above a predetermined value, whether the operating mode of the paving machine is a maneuver mode or a paving mode, and whether the machine speed of the paving machine is less than or equal to a threshold value, and wherein said controlling the operational state of the ventilation system includes automatically switching the operational state of the ventilation system to an OFF state, using the controller, responsive to the speed of the engine being above the predetermined value, the operating mode of the paving machine being one of the maneuver mode or the paving mode, and the machine speed of the paving machine being less than or equal to the threshold value.

2. The method as claimed in claim 1, wherein the operating mode is one of the maneuver mode, the paving mode, and a travel mode.

3. The method as claimed in claim 1, wherein the determined operational state of the washdown system of the paving machine is indicative of whether the washdown system is in an active state or a deactivated state.

4. The method as claimed in claim 1, wherein the switching the operation state of the ventilation system is between an ON state and the OFF state based on the operational data associated with the paving machine and the determined operational state of the washdown system of the paving machine.

5. The method as claimed in claim 1, wherein the operating mode is one of the maneuver mode, the paving mode, or a travel mode, and the determined operational state of the washdown system of the paving machine is indicative of whether the washdown system of the paving machine is in an active state or a deactivated state, and said controlling the operation state of the ventilation system further includes automatically switching, by the controller, the ventilation system to the OFF state when the speed of the engine is above the predetermined value for a predefined time period and the washdown system of the paving machine is in the active state.

6. The method as claimed in claim 5, wherein said controlling the operation state of the ventilation system further includes switching, by the controller, the ventilation system to an ON state when the machine speed is greater than the threshold value and the operating mode of the paving machine is one of the paving mode or the maneuver mode.

* * * * *